United States Patent [19]

Nakazato et al.

[11] 4,139,979

[45] Feb. 20, 1979

[54] APPARATUS FOR SEALING THE HEADS OF CONTAINERS

[75] Inventors: Tetsuo Nakazato, Sakai; Hiroaki Nishihara; Koichi Tokuda, both of Takarazuka; Ryuzo Sukeyasu, Takatsuki, all of Japan

[73] Assignee: Sumitomo Bakelite Company Limited, Tokyo, Japan

[21] Appl. No.: 804,379

[22] Filed: Jun. 7, 1977

[30] Foreign Application Priority Data

Jun. 17, 1976 [JP] Japan ..... 51-72025

[51] Int. Cl.[2] ..... B67B 3/04; B65B 7/28

[52] U.S. Cl. ..... 53/298; 53/307; 53/329

[58] Field of Search ..... 53/296, 297, 298, 307, 53/329, 373, 42, 30 S

[56] References Cited

U.S. PATENT DOCUMENTS

| | | | |
|---|---|---|---|
| 2,955,395 | 10/1960 | Aubry | 53/296 X |
| 3,014,320 | 12/1961 | Harrison | 53/296 X |
| 3,034,271 | 5/1962 | Carpenter et al. | 53/329 |
| 3,112,587 | 12/1963 | Anderson et al. | 53/329 UX |
| 3,197,940 | 8/1965 | Spangler | 53/329 |
| 3,330,094 | 7/1967 | Ford | 53/329 |
| 3,494,098 | 2/1970 | Sternau | 53/329 |
| 3,508,380 | 4/1970 | Nakamura | 53/329 |
| 3,509,682 | 5/1970 | Logemann | 53/329 X |
| 3,625,801 | 12/1971 | Reed et al. | 53/329 X |
| 3,792,566 | 2/1974 | Kinney | 53/298 |
| 3,884,017 | 5/1975 | Butcher | 53/296 |
| 4,035,987 | 7/1977 | Nakazato et al. | 53/298 X |

*Primary Examiner*—Horace M. Culver

*Attorney, Agent, or Firm*—Toren, McGeady and Stanger

[57] ABSTRACT

The apparatus for sealing the heads of containers with a biaxially oriented plastic film comprises a horizontal conveyor for conveying the containers to be sealed, and a horizontal endless belt disposed above the conveyor in parallel thereto and including a lower traveling portion adapted to be driven in the same direction as the conveyor at a speed equal to the speed of the conveyor.

24 Claims, 12 Drawing Figures

APPARATUS FOR SEALING THE HEADS OF CONTAINERS

This invention relates to an apparatus for sealing the heads of containers, and more particularly to an apparatus for sealing the heads of containers with a biaxially oriented plastic film comprising a horizontal conveyor for conveying the containers to be sealed, and a horizontal endless belt disposed above the conveyor in parallel thereto and including a lower traveling portion adapted to be driven in the same direction as the conveyor at a speed equal to the speed of the conveyor, such that during the sealing operation the plastic film is entirely covered with the lower travelling belt portion and slightly pressed thereby against the top end of the container to be sealed on the conveyor, and hot air is applied from nozzles to the peripheral portion of the pressed sheet projecting from the periphery of the head of the container to shrink the peripheral portion and to thereby seal the head of the container with the sheet in the form of a cap.

With the sealing apparatus of this type, the container to be sealed and the sealing sheet thereon are conveyed as held against displacement between the upper belt and lower conveyor arranged in parallel, and the peripheral portion of the sealing sheet projecting from the periphery of the head of the container is exposed to hot air, with the sealing sheet entirely covered with the holding belt. Thus, containers can be cap-sealed more effectively than by apparatus of other types. The apparatus can carry out the sealing operation continuously and automatically with high efficiency when incorporating means for automatically feeding containers to the conveyor and means for automatically cutting out sealing sheets from a continuous plastic film and automatically feeding the sheets to the heads of the containers.

An apparatus of such type for sealing the heads of containers is disclosed, for example, in the specification of U.S. Pat. No. 3,508,380. According to the prior art disclosed, hot air is forced out upward against the container to be sealed from therebelow and is applied to the peripheral portion of the sealing sheet, so that part of the hot air impinging on the lower surface of the holding belt will flow upstream of the container conveyor along the lower belt surface, namely toward the sealing sheet feeding position, consequently exposing the sealing sheet to the hot air and shrinking the sheet before it is pressed against the top end of the container by the holding belt.

Another apparatus for sealing the heads of containers is disclosed, for example, in the specification of Australian Pat. No. 225,318 in which a sealing sheet is held by a horizontal endless belt to the top of a container on a horizontal conveyor, such that hot air is applied to the sealing sheet in a horizontal direction transversely of the belt from hot air ducts arranged on the opposite sides of the lower traveling portion of the belt. According to the latter prior art, the hot air will not impinge on the lower surface of the belt and be forced toward the sealing sheet feeding position, so that the sealing sheet is less likely to be exposed to the hot air than in the former prior art before being pressed by the holding belt against the top end of the container. However, the hot air will flow toward the sheet feeding position due to spontaneous diffusion. Thus the sealing sheet is not always free from the problem of the undesired shrinkage. Further with the latter prior art, the sealing sheet is covered with the holding belt not entirely but partially, with the result that the uncovered portion of the sealing sheet covering the top end of the container will shrink on exposure to the hot air. Consequently, the sealing sheet fails to effectively seal the head of the container in the form of a cap.

Further according to the two prior art references mentioned above, the holding belt tends to rise from the sealing sheet on the container during travel, permitting the hot air to flow into the resulting space between the sealing sheet and the holding belt and causing undesirable shrinkage of the sheet, or the holding belt tends to deviate sidewise, displacing the sealing sheet relative to the head of the container and leading to improper sealing.

Accordingly, the main object of this invention is to eliminate the drawbacks of the prior art and to provide an improved apparatus for sealing the heads of containers with a heat-shrinkable sealing material in the form of a cap, permitting every sealng sheet fed to the container to seal the container satisfactorily as desired.

Other objects of this invention will become apparent from the following description.

This invention provides an apparatus for sealing the heads of containers comprising a horizontal conveyor for conveying the containers to be sealed, a horizontal endless belt disposed above the conveyor in parallel thereto and including a lower traveling portion adapted to be driven in the same direction as the conveyor at a speed equal to the speed of the conveyor, the lower traveling belt portion being operative during the sealing operation to entirely cover a sealing sheet of biaxially oriented plastic film and to slightly press the sheet against the top surface of the container to be sealed after the sheet has been fed to the top surface of the container traveling on the conveyor, and hot air nozzles for applying hot air to the peripheral portion of the pressed sheet projecting from the periphery of the head of the container to shrink the peripheral portion and to thereby seal the head of the container with the sheet in the form of a cap, the apparatus being characterized by the abovementioned hot air nozzles which extend substantially along the opposite side edges of the lower traveling belt portion in the opposed relation thereto respectively and which are positioned at the same level as the lower surface of the lower traveling belt portion, means provided in each of the hot air nozzles for directing the hot air in an oblique direction toward the direction of travel of the lower traveling belt portion from at least one end of its nozzle orifice positioned upstream of the belt portion, and a belt holder disposed at a fixed position for preventing the lower traveling belt portion from rising at least in a sealing zone, the belt holder being provided with plates extending downward therefrom close to the opposite side edges of the lower traveling belt portion respectively and having lower ends positioned substantially at the same level as the lower surface of the lower traveling belt portion.

According to this invention, the nozzles for applying hot air to the sealing sheet over the top end of the container to be sealed extend substantially along the opposite side edges of the lower traveling portion of the endless belt in opposed relation thereto to entirely cover and hold the sealing sheet, the nozzles being positioned at the same level as the lower surface of the belt. The hot air forced out from the nozzles is therefore concentrically and effectively applied to the peripheral portion of the sealing sheet on the top end of the container on the conveyor. Moreover, since each of the nozzles is provided with means by which the hot air to be sent out at least from one end of its nozzle orifice positioned upstream of the lower traveling belt portion is directed in an oblique direction toward the direction of advance of the lower traveling belt portion, the air directing means readily overcomes the problem that the hot air would flow toward the sealing sheet feeding position. Thus the present invention has completely eliminated the objection that the sealing sheet would undesirably shrink on exposure to the hot air before being held by the belt against the top end of the container on the conveyor.

Further according to this invention, the belt holder disposed at a fixed position for preventing the rise of the belt at least in the sealing zone acts to prevent the belt from rising off the sealing sheet on the container during its travel through the sealing zone, so that the sealing sheet can be held entirely covered with the lower traveling belt portion during the sealing operation, without allowing the hot air to flow into a space between the belt portion and the sealing sheet and to cause undesirable shrinkage of the sheet. The belt holder of this invention is further provided with plates extending downward therefrom close to the opposite side edges of the lower traveling belt portion. The part of the lower traveling belt portion holding the sealing sheet to the top end of the container is so restrained by the plates as to travel straight, maintaining the sealing sheet in the original position relative to the head of the container. Moreover, since the lower ends of the plates are positioned substantially at the same level as the lower surface of the lower traveling belt portion, the hot air to be applied from the nozzles to the sealing sheet will not be blocked by the plates or deflected but is forced against the sheet very efficiently.

This invention therefore has the advantage that every sheet fed onto the head of the container can be satisfactorily usable for sealing the head of the container in the form of a cap.

The apparatus of this invention is particularly useful in sealing the heads of cups, cans, bottles, plastic containers and the like containing foods, beverages such as soft drinks, juices or alcoholic beverages, drugs, cosmetics, etc.

These and other objects and features of this invention will be described below in detail with reference to the accompanying drawings showing preferred embodiments of this invention. In the drawings:

Throughout the embodiments shown in FIGS. 1 to 12, like parts are referred to by like reference numerals.

FIGS. 1 to 10 show an embodiment of this invention in which a biaxially oriented plastic film f is set on the apparatus and sealing sheets of predetermined shape and dimensions are cut out from the film to seal the heads of containers.

Figure 1:
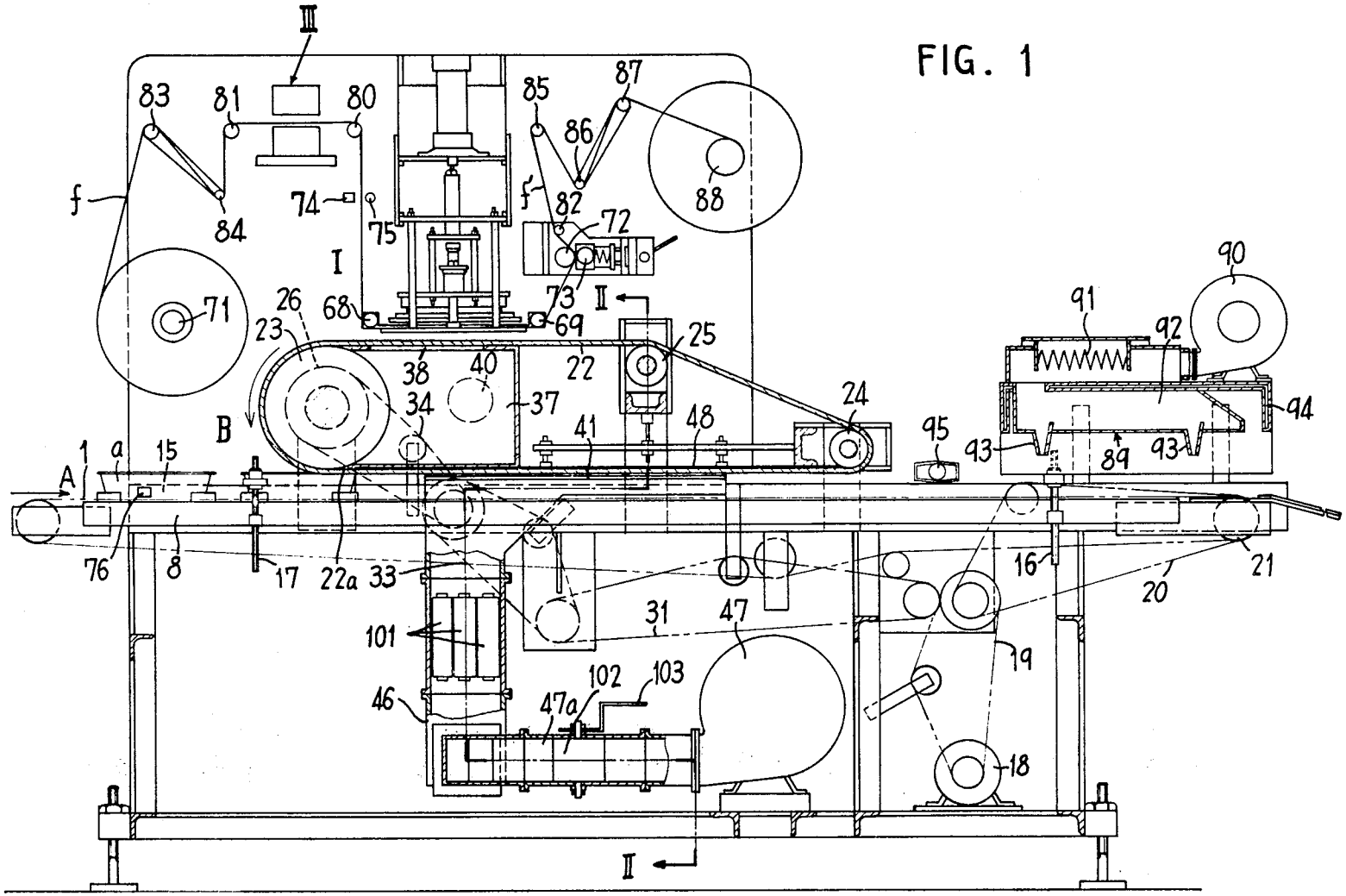
FIG. 1 is a front view showing a preferred embodiment of the apparatus of this invention.
Figure 2:
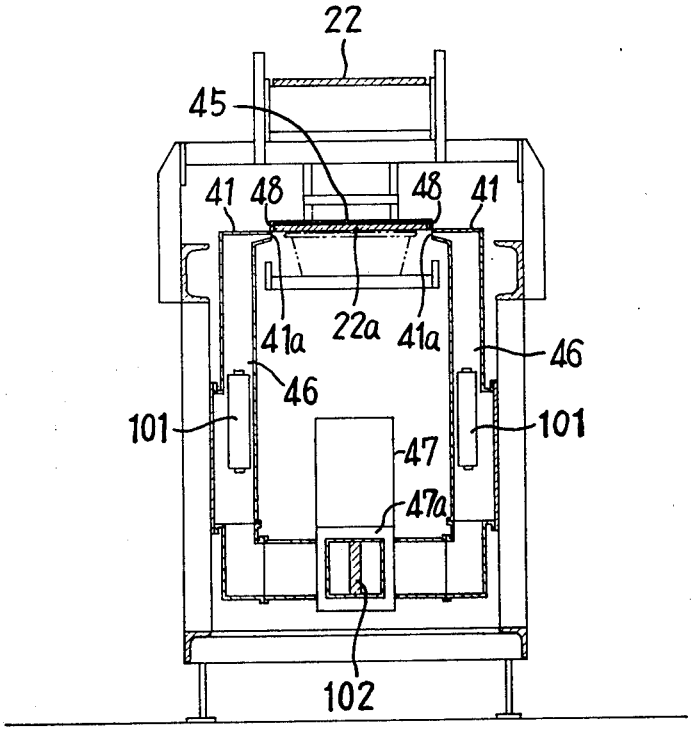
FIG. 2 is a view in section taken along the line II—II in FIG. 1.
Figure 3:
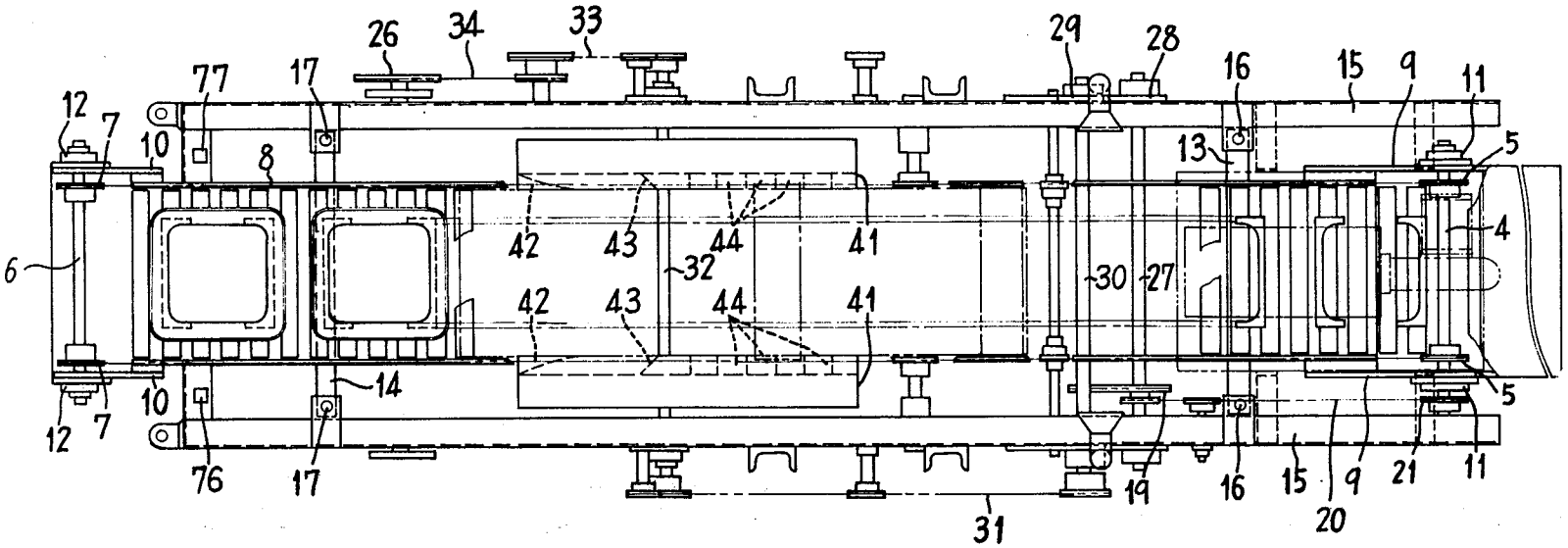
FIG. 3 is a plan view showing a conveyor included in the embodiment of FIG. 1 and the part below the conveyor.
Figure 4:
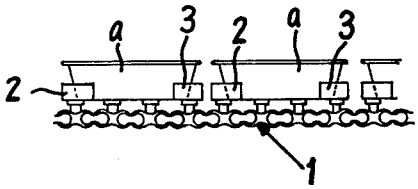
FIG. 4 is a fragmentary enlarged front view of a conveyor chain portion of the embodiment.
Figure 5:
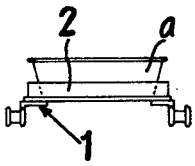
FIG. 5 is a side elevation showing the conveyor chain portion shown in FIG. 4.
Figure 6:
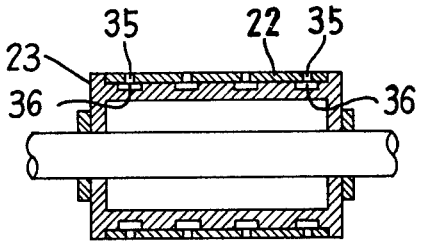
FIG. 6 is a view in vertical section showing a belt driving drum included in the embodiment.
Figure 7:
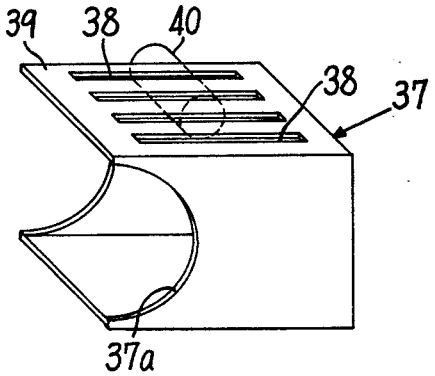
FIG. 7 is an enlarged perspective view of a suction box included in the embodiment.
Figure 8:
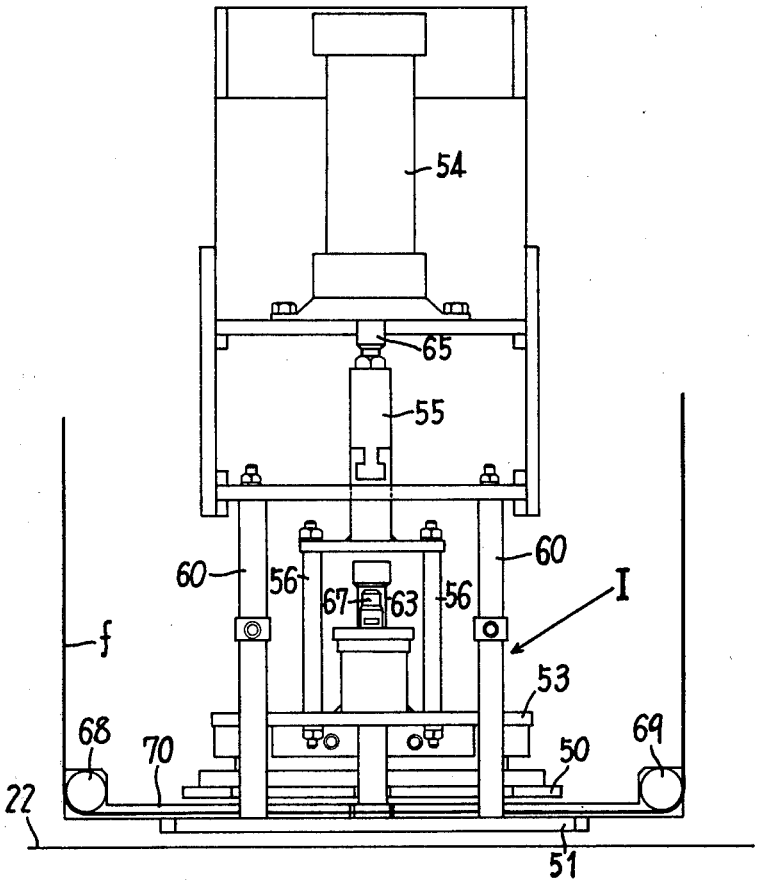
FIG. 8 is an enlarged front view of means shown in FIG. 1 for cutting out sealing sheets.
Figure 9:
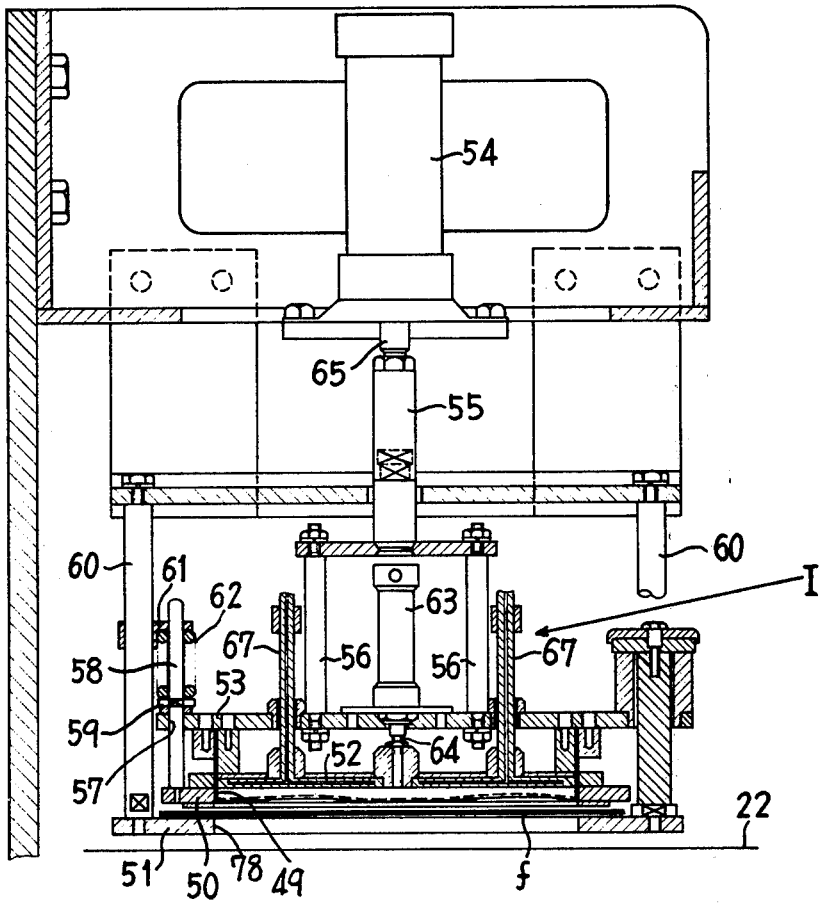
FIG. 9 is a side elevation partly in vertical section showing the means illustrated in FIG. 8.
Figure 10:
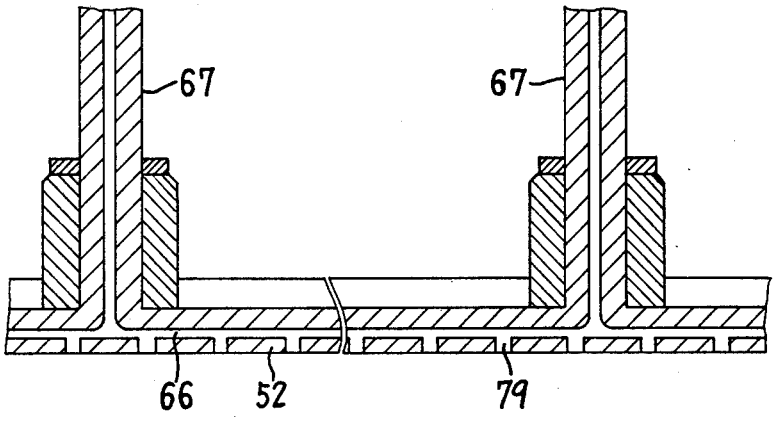
FIG. 10 is an enlarged view showing an air applicator illustrated in FIG. 9.

The embodiment shown in FIGS. 1 to 10 includes a horizontal conveyor 1 for conveying the containers a to be sealed. The conveyor 1 is in the form of a chain conveyor provided with pairs of front and rear attachments 2 and 3 arranged at regular spacing and adapted for receiving and retaining the containers. Insofar as the pair of attachments are adapted to receive and retain the container a in the space therebetween, the attachments need not be opposed to each other in the direction of travel of the conveyor but may be opposed transversely thereof. The pair of attachments may alternatively be in the form of a single tray.

The chain conveyor 1 is reeved around sprocket wheels 5 mounted on the opposite ends of and to be driven by a spindle 4 and sprocket wheels 7 mounted on the opposite ends of a shaft 6. The spindle 4 and the shaft 6 are supported by arms 9 and 10 secured to the front and rear ends of a horizontal frame 8, by means of bearings 11 and 12. The horizontal frame 8 is provided with cross bars 13 and 14 secured thereto. The frame 8 is attached to the main frame 15 by the cross bars and level adjusting screws 16 and 17 vertically shiftably for adjustment. Accordingly, the conveyor 1 is vertically shiftable for adjustment by vertically shifting the horizontal frame 8. This permits the lower traveling portion **22*a* of a horizontal endless belt 22** for sealing sheets to exert optimum pressure on the heads of containers a of varying heights.

The conveyor 1 is driven in the direction of the arrow A in FIG. 1 by a motor 18 by way of transmission chains 19, 20, a drive sprocket wheel 21 on the spindle 4, the spindle 4 and the sprocket wheels 5.

The endless belt 22 is disposed above the conveyor 1 in parallel thereto, with its lower traveling portion **22*a* spaced from the conveyor 1 by such a distance that the portion 22*a* will come into slightly pressing contact with the top surfaces of the containers a retained between the attachments 2 and 3 on the conveyor 1. The belt 22 is reeved around a drive drum 23, a roller 24 and a tension roller 25 mounted on the main frame 15. The drive drum 23 for the endless belt 22 is provided with a drive sprocket wheel 26 at one end of its shaft. The belt 22 is driven in the direction of the arrow B in FIG. 1 at the same speed as the conveyor 1 by the motor 18 via the transmission chain 19, a shaft 27, transmission gears 28, 29, a shaft 30, transmission chain 31, a shaft 32, transmission chains 33, 34 and the drive sprocket wheel 26**.

The horizontal endless belt 22 may preferably be formed with a great number of apertures 35 over its entire surface. When the sealing sheet is placed onto the upper surface of the upper traveling portion of the belt 22, the air between the sheet and the belt will escape through the apertures 35, permitting the sealing sheet to be retained on the belt 22 free of any displacement. Consequently, if the feeding position and timing for the sealing sheet relative to the belt 22 are properly predetermined, the sealing sheet can be fed to the top end of the container a accurately concentrically therewith. This can be achieved more effectively by applying slight suction to the apertures 35 over an area extending from the sheet feeding position to the peripheral surface of the drum 23. However, satisfactory results are attainable with the apertures 35 alone without using any suction. Usually, the sealing sheets are electrostatically charged during the manufacture of the elongated biaxially oriented plastic film from which they are prepared or when they are cut out from the film, so that they adhere to the belt 22. The means for applying suction to the belt 22 over the above mentioned area may comprise, for example, a suction box 37 disposed in a fixed position and having an upper wall plate 39 formed with openings 38 in corresponding relation to the aperatures 35 (see FIG. 7). The suction box 37 has a duct 40 in communication with a suitable suction source such as a vacuum pump (not shown). The suction to be applied to the belt over the peripheral surface of the drum 23 may be provided, for example, through a suitable number of grooves 36 formed in the peripheral surface of the drum 23 circumferentially thereof in corresponding relation to the apertures 35 and communicating with the interior space of the suction box 37. The grooves 36 can be maintained in communication with the interior space of the suction box 37 by suitable means, for example, by forming an open end 37*a* in the box 37 in opposed relation to the drum 23, providing the side walls of the box with circular arc edges at the open end in conformity with the periphery of the drum and holding the circular edges in contact with the drum periphery.

Hot air nozzles 41 are opposed to and extend substantially along the opposite side edges of the lower traveling portion 22*a* of the belt 22.. The nozzles are positioned at the same level as the lower surface of the portion 22*a*. Although the nozzles 41 of the illustrated embodiment continuously extend along the opposite side edges of the lower traveling portion 22*a* of the belt, the continuous nozzle 41 may be replaced by a plurality of nozzles arranged close to each other and aligned along each side edge of the lower traveling portion 22*a* of the belt. The hot air nozzle 41 on each side of the belt is provided with means by which the hot air to be forced out from at least one end of its nozzle orifice 41*a* positioned upstream of the lower traveling portion 22*a* is directed in an oblique direction toward the direction of the advance of the portion 22*a*. When a plurality of nozzles are used on each side of the belt, the orifices of some of the nozzles may be provided with like means. In the illustrated embodiment, air guide plates 42 and 43 are used as the above-mentioned means. At the portion other than where the air guide plates 42 and 43 are disposed, the nozzle orifice 41*a* may preferably be provided with a suitable number of plates 44 by which the hot air to be forced out from this portion will be directed toward the peripheral portion of the sealing sheet with improved effectiveness. Satisfactory results can be achieved when the latter plates 44 are disposed at right angles to the longitudinal direction of the belt 22, although they may be oriented in the same direction as the plates 42 and 43. Each of the nozzles 41 incorporates a heater 101 and communicates with the outlet 47*a* of a pressurized air source 47 such as an air compressor or blower. The outlet 47*a* is provided with a damper 102 which is turnable about a vertical axis extending across the outlet. The pressurized air can be supplied at an equal rate to the ducts 46, therefore to the nozzles 41 on the opposite sides by adjusting the damper 102. Indicated at 103 is the handle of the damper 102.

A belt holder 45 extends over part of the lower traveling portion 22*a* of the belt 22 corresponding to a sealing zone, i.e. to a heating zone provided longitudinally of the belt 22 by the hot air forced out from the nozzle orifices 41*a*. The belt holder 45 has plates 48 extending downward therefrom and close to the opposite side edges of the lower traveling portion 22*a* (see FIG. 2). The lower edges of the plates 48 are substantially at the same level as the lower surface of the traveling portion 22*a*.

Sealing sheet cutting-out means I is disposed at a specified position above the upper traveling portion of the belt 22 in proximity thereto. The means I schematically shown in FIG. 1 is illustrated in greater detail in FIGS. 8 to 10.

The means I for cutting out sealing sheets comprises a substantially annular punch 49, a clamp 50 slidably fitting around the punch 49, a stationary clamp 51 disposed below and opposed to the clamp 50, and an air applicator 52 slidably fitting in the punch 49. Preferably the annular shape of the punch 49 is substantially similar to the shape of the head of the container in plan view so that the peripheral portion of the sealing sheet will be satisfactorily shrinkable along the periphery of the container head. The lower clamp 51 has a lower edge 78 coacting with the punch 49.

The punch 49 is formed at its lower end with a blade comprising a plurality of inverted V-shaped edges arranged along the entire circumference of the punch over an equal distance so as to cut out the sealing sheets effectively. Preferably, the blade is in the form of serrated teeth. When cutting out a sealing sheet from the film f, the blade will come into point contact with the film f, with a uniform force acting on the entire periphery of the punch 49, thus ensuring an effective cutting-out operation. The annular punch 49 is secured to the bottom of a plate 53 secured to the lower ends of columns 56 whose upper ends are secured to the lower end of a vertical shank 55. The shank 55 is secured to the lower end of the plunger 65 of an air cylinder or hydraulic cylinder 54 such as water pressure cylinder. The upper clamp 50 is secured to the lower ends of vertical rods 58 (only one rod shown in FIG. 9 to simplify the drawing) slidably extending through holes 57 at the four corners of the plate 53. Each of the vertical rods 58 is fixedly provided at its intermediate portion with a collar 59 resting on the plate 53. Slide shoes 61 (only one shown in FIG. 9) secured to the plate 53 by unillustrated means and slidable on columns 60 are mounted on the upper ends of the vertical rods 58 respectively. A coiled spring 62 is provided between the collar 59 and the slide shoe 61. The lower clamp 51 is secured to the lower ends of the columns 60 and is positioned close to the upper surface of the upper traveling portion of the belt 22. The air applicator 52 is mounted on the lower end of the plunger 64 of an air cylinder or a hydraulic cylinder 63 such as water pressure cylinder secured to the plate 53. The air applicator 52 has air supply ducts 67 in communication with its interior space 66 (see FIG. 10) and with an unillustrated source for supplying air at room temperature. The sealing sheet cutting-off means I is further provided with rollers 68 and 69 for guiding the continuous film f. The rollers 68 and 69 are supported by a support 70 mounted on the columns 60 or some other suitable fixed member in such arrangement that the film f will be passed through the space between the upper clamp 50 and the lower clamp 51.

The apparatus shown in FIGS. 1 to 10 will operate in the following manner.

The continuous film f wound on a beam 71 is paid out by a predetermined length by feed rollers 72 and 73, at least one of which is forced to rotate, over a guide roll 83, a tension roller 84 of the gravity type, guide rollers 81, 80, 68 and 69. When desired, the film paying-out line may be provided with stamping means III between suitable guide rollers, for example between the rollers 81 and 80 for stamping the film with a device or letters indicating the date of production or the like. The stamping means III may be of any known type such for example as one in which the types for impressing letters or a device are downwardly movable by depressing a rod while being inked during the downward movement to stamp the article to be stamped, the types being returnable to the original position for the subsequent stamping operation by raising the rod. The depressing rod is operable by suitable known mechanical means.

After the predetermined length of the film f has been paid out, the rollers 72 and 73 are halted under the control of suitable known means.

In the case where the portion of the film f to be cut out as a sealing sheet is marked with a device or date of the production or sealing of the product in the container, it is preferable to bring the marked portion to the position where it will oppose the punch correctly. This can be ensured by detecting the passage of the portion over a specified point with the use of detecting means such as a photoelectric tube 74 and a projector 75 disposed at a specified position on the path of travel of the film f. The detecting means detects the passage of the marked portion over the specified position, in response to which an unillustrated motor for driving the feed rollers 72 and 73 is so controlled that the desired portion of the film f will be stopped at the correct position opposed to the punch. Such control can be effected in a suitable known manner.

The sealing sheet cutting-out means I is brought into operation with the film f held in its stopped position. To eliminate the waste of the sealing material, the means I can be operated only when the container a to be sealed is positioned on the conveyor 1 by a control system including suitable detecting means for detecting the presence or absence of the container a on the conveyor 1. The detecting means comprises, for example, a photoelectric tube 76 and a projector 77 disposed at a specified position along the path of travel of the conveyor 1. The detecting means detects the passage of the container a on the conveyor 1, in response to which the means I is operated.

The operation of the means I is initiated with the lowering of the plunger 64 by the cylinder 54. This moves down the plate 53 through the shank 55 and columns 56. The upper clamp 50 moves down with the plate 53. Even after the upper clamp 50 comes into contact with the film f on the lower clamp 51, the plate 53 continues to descend, with the result that the slide shoes 61 descending with the plate 53 cause the spring 62, collars 59 and rods 58 to force the upper clamp 50 against the lower clamp 51 with the film f interposed therebetween. Thus the film f is clamped between the two clamps 50 and 51.

With the film f clamped as above, the plate 53 further continues to descend. Accordingly, the punch 49 continues to descend therewith and coacts with the lower cutting edge 78 to cut out a sealing sheet of predetermined shape and dimensions from the film f.

Subsequent to the cutting operation, the cylinder 63 on the air applicator 52 is actuated, causing the plunger 64 to lower the air applicator 52. The timing for the operation of the cylinder 63 is controlled in a suitable known manner. The air applicator 52 is lowered to a predetermined level, slightly pressing with its bottom the cut-out sealing sheet against the upper surface of the upper traveling portion of the belt 22. Simultaneously with this or immediately thereafter, air is introduced from the air supply source into the hollow space in the air applicator 52 by way of the duct 67 and is forced out downward from a plurality of air holes 79 formed in the bottom of the air applicator 52. Consequently, the sealing sheet is completely released from the means I and fed to the upper surface of the upper traveling portion of the belt 22.

On completion of the cutting operation, the operative portions of the means I described above are returned to the original positions for the next cutting operation under the control of suitable known means. A sealing sheet is cut out every time one container is fed in the manner to be described below.

The film from which the sealing sheets are cut out, namely scrap f', is wound on a take-up beam 88 via guide rollers 82 and 85, a tension roller 86 of the gravity type and a guide roller 87.

The sealing sheet cut out from the film f is attracted to the surface of the upper traveling portion of the belt 22 by the electrostatic charge thereon and is carried toward the conveyor line 1 with the travel of the belt 22.

The containers a to be sealed are received one after another in the spaces between the pairs of attachments 2 and 3 at the upstream end of the conveyor 1 and are transported thereon in the direction of the arrow A in FIG. 1. The transport of the containers a on the conveyor 1 and the advance of the sealng sheets on the belt 22 are effected in such timed relation that the container a meets the sealing sheet on the path of travel of the lower traveling portion **22*a* of the belt 22** under the control of suitable known means.

When the top of the container a on the conveyor 1 meets the sealing sheet on the lower surface of the lower traveling portion **22*a* of the belt 22 substantially at the same level, the sealing sheet is slightly pressed against the top of the head of the container a by the lower traveling portion 22*a* of the belt 22 and retained against displacement. In this state, the sealing sheet and the container are passed through the sealing zone with the travel of the conveyor 1 and the belt 22**.

In the sealing zone, the sealing sheet on the container a is held entirely covered with the lower traveling portion **22*a* of the belt, with the result that the peripheral portion of the sheet projecting from the periphery of the head of the container a only is exposed to the hot air forced out from the nozzles 41 on the opposite sides of the lower traveling portion 22*a***. Thus, the peripheral portion of the sealing sheet shrinks, and the sheet seals the container head in the form of a cap.

In the sealing zone, the lower traveling portion **22*a* is prevented from rising by the belt holder 45 and from sidewise deviation by the plates 48**, whereby the sealing sheet is held in place relative to the container a during the sealing operation, effectively sealing the head of the container in the form of a cap.

The hot air sent out from the nozzles 41 will not flow upstream of the lower traveling portion 22a of the belt, because at least one end of each nozzle orifice positioned upstream of the portion 22a the hot air is directed by the air guide plates 42 and 43 in an oblique direction toward the direction of advance of the portion 22a. Consequently, the sealing sheet will not be shrunk and rendered useless by exposure to the hot air before being pressed by the lower traveling portion 22a against the top of the container a on the conveyor 1.

When desired, second heat exposure means may be provided above the conveyor 1 subsequent to the sealing zone to shrink the portion of the sealing sheet covering the top of the container by exposure to the heat and to thereby eliminate creases when the container passes below the heat exposure means. An infrared heater (not shown) or a hot air applicator 89 shown in FIG. 1 is usable as the second heat exposure means. With the illustrated applicator 89, the air sent out from a blower 90 is heated by an electric heating wire 91 and is thereafter forced out from nozzles 93 on the bottom of a box 92 against the portion of the sealing sheet covering the top end of the container. To prevent the overheating of the air within the box 92, the applicator 89 includes a heat insulating jacket 94 surrounding the top and side walls of the box 92.

In order to effectively eliminate creases from the sealing sheet covering the top of the container with the use of the second heat exposure means, it is preferable to provide a nozzle 95 at a fixed position upstream from the heat exposure means for applying cold air over the head of the container. Particular air cooling means need not be used but air having room temperature will give satisfactory results.

Figure 11:
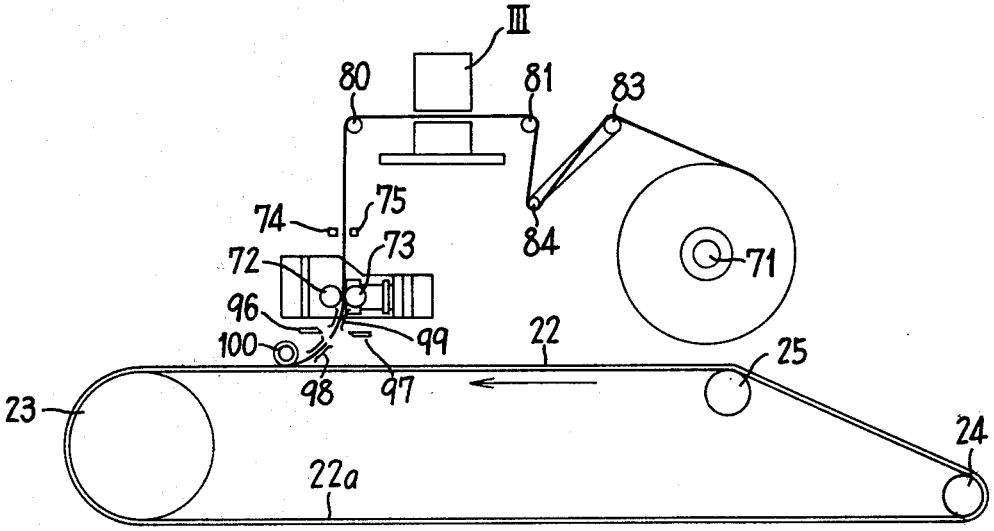
FIG. 11 is a front view showing a modification of means for preparing sealing sheets from a continuous plastic film.

If the containers to be sealed have a substantially square to rectangular shape (which may be rounded at the four corners) in plan view, the continuous film set on the present apparatus may be cut transversely thereof over its entire width to obtain sealing sheets in a shape substantially similar to the shape of the head of the container in plan view, instead of employing a punch. FIG. 11 shows an embodiment of such type. FIG. 11 does no show the sealing zone for the sealing sheets, conveyor for the containers, belt holder, plates attached to the belt holder, belt drive system, etc. which are incorporated in the embodiment and which have the same structure are those already described.

With reference to the embodiment shown in FIG. 11, a film f is paid out by a predetermined length by means of feed rollers 72 and 73 and is cut by a movable cutter blade 96 and a stationary cutter blade 97 over the entire width thereof. The sealing sheet thus obtained is fed to the upper surface of the upper traveling portion of the belt 22 by way of a guide chute 98. A guide 99 for guiding the film f to the blades 96, 97 is disposed between the location of the blades 96, 97 and the location of the feed rollers 72 and 73. Provided immediately above the upper traveling portion of the belt 22 is a roller 100 by which the sealing sheet fed to the portion is slightly pressed against the upper surface of the belt. Like the embodiment shown in FIGS. 1 to 10, it is preferable that the belt 22 shown in FIG. 11 be formed with apertures over the entire surface thereof to render the sealng sheet retainable thereon free of any displacement. Like the first embodiment, the embodiment shown in FIG. 11 may further incorporate the sealing sheet sucking means (i.e. grooves 36 in the peripheral surface of the drum 23 and suction box 37) to eliminate the displacement of the sealing sheet on the belt 22 with greater effectiveness. When desired, the present embodiment may include second heat exposure means, preferably in combination with a fixed nozzle for applying cold air over the head portions of the sealed containers.

Figure 12:
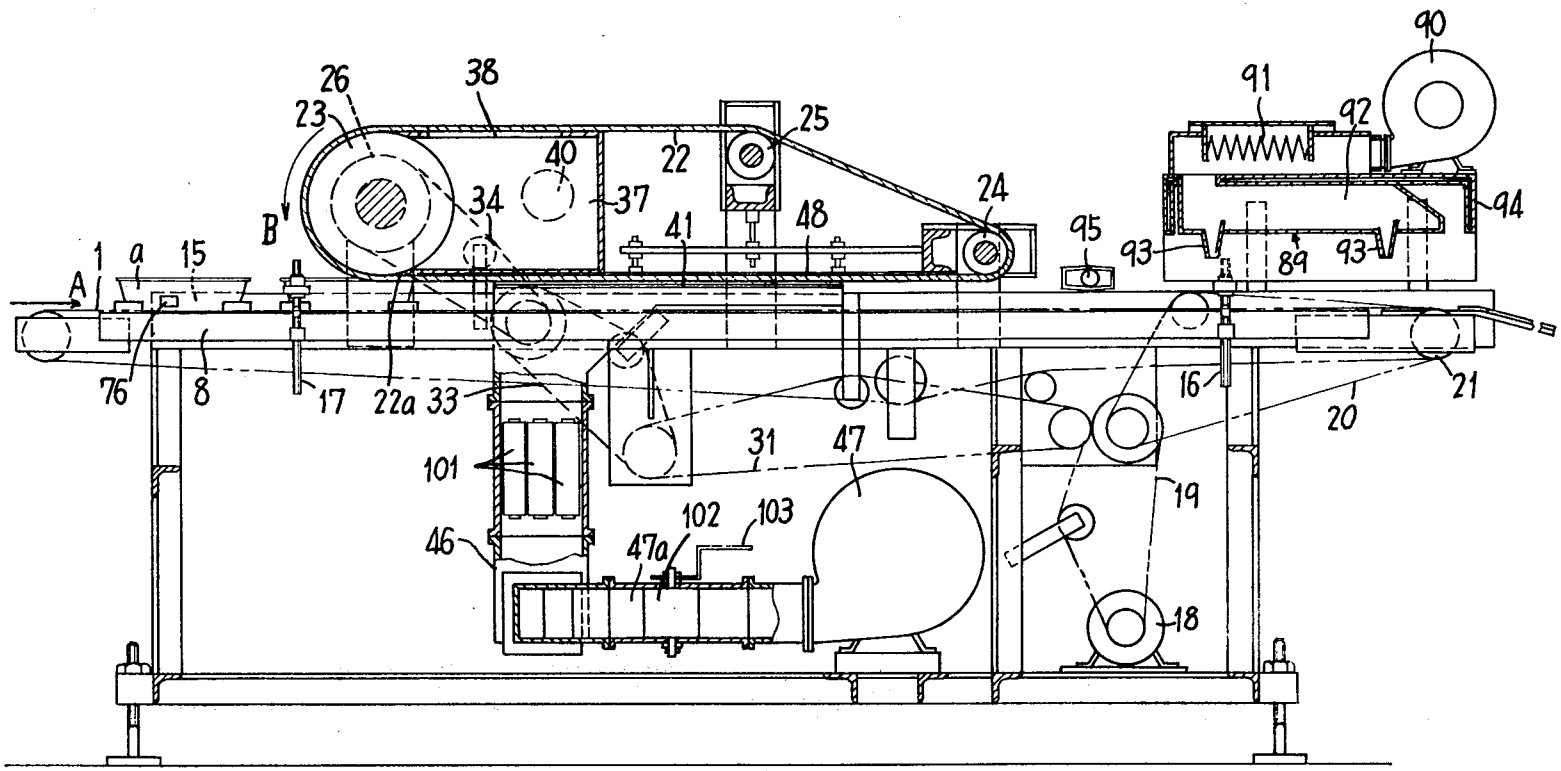
FIG. 12 is a front view showing another embodiment of the present apparatus.

According to this invention, the heads of containers can be sealed in the form of a cap with preformed sealing sheets obtained by cutting or cutting out a continuous plastic film which is not set on the apparatus of this invention. FIG. 12 shows such an embodiment.

The embodiment of FIG. 12 corresponds to the embodiment shown in FIGS. 1 to 10 or in FIG. 11 from which the sealing sheet cutting or cutting-out means and the film setting means are eliminated.

With the embodiment of FIG. 12, the sealing sheets are manually placed on the top of the containers to be sealed, after or before the containers are fed onto the conveyor 1. With the embodiment of FIG. 12, a belt conveyor is usable for the containers in place of the conveyor of the type described above.

What we claim is:

1. An apparatus for sealing the heads of containers with a heat-shrinkable film comprising a horizontal conveyor for conveying the containers to be sealed; a horizontal endless belt disposed above the conveyor in parallel thereto and including a lower traveling portion adapted to be driven in the same direction as the conveyor at a speed equal to the speed of the conveyor, the lower traveling belt portion being operative during the sealing operation to entirely cover a sealing sheet of biaxially oriented plastic film and to slightly press the sheet against the top surface of the container to be sealed after the sheet has been fed to the top surface of the container traveling on the conveyor; hot air nozzle means for applying hot air to the peripheral portion of the pressed sheet projecting from the periphery of the head of the container to shrink the peripheral portion and to thereby seal the head of the container with the sheet in the form of a cap, the hot air nozzle means extending substantially along the opposite side edges of the lower traveling belt portion in opposed relation thereto respectively and positioned at the same level as the lower surface of the lower traveling belt portion, each of the hot air nozzle means comprising a plurality of nozzles arranged close to each other and aligned along the side edge of the lower traveling belt portion; means for intermittently feeding a continuous heat-shrinkable film to a position close to and above an upper traveling portion of the belt in parallel thereto; and cutter means disposed above the upper traveling belt portion for cutting out the sealing sheet from the film.

2. An apparatus as defined in claim 1 wherein the cutter means includes a vertically movable annular punch having a blade at its lower end and a stationary die member disposed below and cooperative with the punch, and further comprising clamp means for clamping the heat-shrinkable film along the portion thereof to be cut out, the clamp means including a vertically movable upper member and a stationary lower member for clamping the film therebetween while the sealing sheet is being cut out.

3. An apparatus as defined in claim 2 further comprising means for forcing the sealing sheet downward away from the cutter means.

4. An apparatus as defined in claim 1 wherein the cutter means includes a movable blade and a stationary blade for cutting the film transversely thereof over its entire width.

5. An apparatus as defined in claim 1 further comprising means for applying heat to the portion of the sheet covering the top end of the container, the heat applying means being disposed above the conveyor subsequent to the endless belt.

6. An apparatus as defined in claim 5 further comprising means for applying cold air over the head of the container, the cold air applying means being interposed between the endless belt and the heat applying means.

7. An apparatus as defined in claim 1 further comprising attachments for retaining the containers on the conveyor at regular spacing, the cutter means being operative at a time interval corresponding to the spacing distance between the containers on the conveyor.

8. An apparatus as defined in claim 1 wherein the belt is formed with apertures over its entire surface.

9. An apparatus as defined in claim 8 further comprising means for applying suction to the belt apertures to draw the sealing sheet against the belt, the apertures being provided over an area extending from the position where the sealing sheet is fed to the belt to a position immediately adjacent the position where the sealing sheet on the belt meets the container on the conveyor.

10. An apparatus for sealing the heads of containers with a heat-shrinkable film comprising a horizontal conveyor for conveying the containers to be sealed; a horizontal endless belt disposed above the conveyor in parallel thereto and including a lower traveling portion adapted to be driven in the same direction as the conveyor at a speed equal to the speed of the conveyor, the lower traveling belt portion being operative during the sealing operation to entirely cover a sealing sheet of biaxially oriented plastic film and to slightly press the sheet against the top surface of the container to be sealed after the sheet has been fed to the top surface of the container traveling on the conveyor; hot air nozzle means for applying hot air to the peripheral portion of the pressed sheet projecting from the periphery of the head of the container to shrink the peripheral portion and to thereby seal the head of the container with the sheet in the form of a cap, the hot air nozzle means extending substantially along the opposite side edges of the lower traveling belt portion in opposed relation thereto respectively and positioned at the same level as the lower surface of the lower traveling belt portion, each of the hot air nozzle means comprising a plurality of nozzles arranged close to each other and aligned along the side edge of the lower traveling belt portion; means provided with said hot air nozzle means for directing hot air away from a direction upstream of the movement of said containers, said means being at least provided upstream of the one of said plurality of nozzles located at the furthest upstream location; means for intermittently feeding a continuous heat-shrinkable film to a position close to and above an upper traveling portion of the belt in parallel thereto; cutter means disposed above the upper traveling belt portion for cutting out the sealing sheet from the film.

11. Apparatus for sealing containers with heat-shrinkable film comprising: conveyor means for moving containers to be sealed in a given direction through a sealing operation; means for applying to said containers on said conveyor means plastic film suitable for sealing said containers; belt means including a belt portion traveling in a direction generally parallel to said given direction of said containers and arranged to entirely cover said plastic film on said containers and to press said film in a sealing position upon said containers during said sealing operation; hot air nozzle means for applying hot air to peripheral portions of said film projecting beyond the periphery of said containers to shrink said peripheral portions thereby to seal said film onto said containers; said hot air nozzle means extending substantially along opposite sides of said traveling belt portion in opposed relationship and positioned at essentially the same level as said traveling belt portion; said hot air nozzle means being constructed to include nozzle orifoce means through which hot air is directed at said peripheral portions, said nozzle orifice means being arranged to extend along the side edges of said traveling belt portions for a distance at least along portions of the path traveled by said containers during sealing operation; and means provided with said hot air nozzle means for directing hot air away from a direction upstream of the movement of said containers through said sealing operation, said means being provided at least at the upstream end of said nozzle orifice means.

12. Apparatus according to claim 11 wherein said nozzle orifice means extend continuously along said portions of said path traveled by said containers.

13. Apparatus according to claim 11 wherein said nozzle orifice means extend intermittently along said portions of said path traveled by said containers.

14. Apparatus according to claim 11 wherein said means for directing hot air away from the direction upstream of the movement of said containers comprise plates extending obliquely to the given direction of movement of said containers.

15. Apparatus according to claim 11 wherein said means for directing hot air away from said direction upstream of the movement of said containers comprise a plurality of plates extending generally perpendicularly to said given direction of movement of said containers.

16. An apparatus for sealing the heads of containers with a heat-shrinkable film comprising a horizontal conveyor for conveying the containers to be sealed; a horizontal endless belt disposed above the conveyor in parallel thereto and including a lower traveling portion adapted to be driven in the same direction as the conveyor at a speed equal to the speed of the conveyor, the lower traveling belt portion being operative during the sealing operation to entirely cover a sealing sheet of biaxially oriented plastic film and to slightly press the sheet against the top surface of the container to be sealed after the sheet has been fed to the top surface of the container traveling on the conveyor; hot air nozzle means for applying hot air to the peripheral portion of the pressed sheet projecting from the periphery of the head of the container to shrink the peripheral portion and to thereby seal the head of the container with the sheet in the form of a cap, the hot air nozzle means extending substantially along the opposite side edges of the lower traveling belt portion in opposed relation thereto respectively and positioned at the same level as the lower surface of the lower traveling belt portion, each of the hot air nozzle means comprising a nozzle continuously extending along the side edge of the lower traveling belt portion; means provided in each of the hot air nozzle means for directing the hot air in an oblique direction toward the direction of travel of the lower traveling belt portion from at least one end of its nozzle orifice positioned upstream of the belt portion; a belt holder disposed at a fixed position for preventing the lower traveling belt portion from rising at least in a sealing zone, the belt holder being provided with plates extending downward therefrom close to the opposite side edges of the lower traveling belt portion respectively and having lower ends positioned substantially at the same level as the lower surface of the lower traveling belt portion; means for intermittently feeding a continuous heat-shrinkable film to a position close to and above an upper traveling portion of the belt in parallel thereto; and cutter means disposed above the upper traveling belt portion for cutting out the sealing sheet from the film.

17. An apparatus as defined in claim 16, wherein the cutter means includes a vertically movable annular punch having a blade at its lower end and a stationary die member disposed below and cooperative with the punch, and further comprising clamp means for clamping the heat-shrinkable film along the portion thereof to be cut out, the clamp means including a vertically movable upper member and a stationary lower member for clamping the film therebetween while the sealing sheet is being cut out.

18. An apparatus as defined in claim 17 further comprising means for forcing the sealing sheet downward away from the cutter means.

19. An apparatus as defined in claim 16 wherein the cutter means includes a movable blade and a stationary blade for cutting the film transversely over its entire width.

20. An apparatus as defined in claim 16 further comprising means for applying heat to the portion of the sheet covering the top end of the container, the heat applying means being disposed above the conveyor subsequent to the endless belt.

21. An apparatus as defined in claim 20 further comprising means for applying cold air over the head of the container, the cold air applying means being interposed between the endless belt and the heat applying means.

22. An apparatus as defined in claim 16 further comprising attachments for retaining the containers on the conveyor at regular spacing, the cutter means being operative at a time interval corresponding to the spacing distance between the containers on the conveyors.

23. An apparatus as defined in claim 16 wherein the belt is formed with apertures over its entire surface.

24. An apparatus as defined in claim 23 further comprising means for applying suction to the belt apertures to draw the sealing sheet against the belt, the apertures being provided over an area extending from the position where the sealing sheet is fed to the belt to a position immediately adjacent the position where the sealing sheet on the belt meets the container on the conveyor.

* * * * *